US011971179B2

(12) United States Patent
Lee et al.

(10) Patent No.: US 11,971,179 B2
(45) Date of Patent: Apr. 30, 2024

(54) AIR CONDITIONER

(71) Applicant: SAMSUNG ELECTRONICS CO., LTD., Suwon-si (KR)

(72) Inventors: Jungdae Lee, Suwon-si (KR); Buyoun Lee, Suwon-si (KR); Wangbyung Chae, Suwon-si (KR); Jongwhal Kim, Suwon-si (KR); Hyeonu Park, Suwon-si (KR); Kyeongae Lee, Suwon-si (KR); Chang-Woo Jung, Suwon-si (KR); Sung-June Cho, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 466 days.

(21) Appl. No.: 16/845,514

(22) Filed: Apr. 10, 2020

(65) Prior Publication Data

US 2020/0326079 A1 Oct. 15, 2020

(30) Foreign Application Priority Data

Apr. 10, 2019 (KR) ..... 10-2019-0041974

(51) Int. Cl.
*F24F 1/0014* (2019.01)
*F24F 13/08* (2006.01)
*F24F 13/20* (2006.01)

(52) U.S. Cl.
CPC ..... *F24F 1/0014* (2013.01); *F24F 13/081* (2013.01); *F24F 13/082* (2013.01); *F24F 2013/205* (2013.01)

(58) Field of Classification Search
CPC ..... F24F 1/0014; F24F 13/081; F24F 13/082; F24F 2013/205; F24F 1/028; F24F 1/029; F24F 1/54; F24F 1/0003
(Continued)

(56) References Cited

U.S. PATENT DOCUMENTS 7,152,911 B1 12/2006 McNulty et al.
7,249,466 B2 7/2007 Park et al.
(Continued)

FOREIGN PATENT DOCUMENTS

CN 1594997 A 3/2005
CN 101178244 A 5/2008
(Continued)

OTHER PUBLICATIONS

Chinese Office Action dated Sep. 28, 2022 in Chinese Patent Application No. 202010278631.5 (9 pages; 9 pages English translation).
(Continued)

*Primary Examiner* — Avinash A Savani
*Assistant Examiner* — Ryan L Faulkner
(74) *Attorney, Agent, or Firm* — STAAS & HALSEY LLP

(57) ABSTRACT

Provided is an air conditioner including: a housing; an outlet configured to discharge air introduced into the housing; a discharge panel arranged in front of the outlet and having a plurality of discharge holes to discharge air; and a support member arranged between the outlet and the discharge panel and on which the discharge panel is to be supported. The support member includes a first frame to support one side of the discharge panel and formed to extend in a first direction, a second frame to support another side of the discharge panel and arranged parallel with the first frame, and a third frame arranged between the first frame and the second frame and formed to extend in a second direction perpendicular to the first direction, wherein the third frame is formed of a metal material.

19 Claims, 11 Drawing Sheets

(58) Field of Classification Search
USPC ..... 62/259.1
See application file for complete search history.

(56) References Cited

U.S. PATENT DOCUMENTS

| | | | | |
|---|---|---|---|---|
| 8,037,707 | B2 | 10/2011 | Lee et al. | |
| 8,573,717 | B2 * | 11/2013 | Liu | G06F 1/181 361/679.6 |
| 10,823,433 | B2 | 11/2020 | Cho et al. | |
| 2005/0092015 | A1 * | 5/2005 | Park | F24F 13/20 62/426 |
| 2008/0104988 | A1 * | 5/2008 | Lee | F24F 13/222 62/285 |
| 2016/0131369 | A1 | 5/2016 | Jung et al. | |
| 2017/0016634 | A1 | 1/2017 | Lee et al. | |
| 2018/0335221 | A1 | 11/2018 | Cho et al. | |

FOREIGN PATENT DOCUMENTS

| | | | | | |
|---|---|---|---|---|---|
| CN | 101277748 | A | | 10/2008 | |
| CN | 101415598 | A | | 4/2009 | |
| CN | 101418964 | A | | 4/2009 | |
| CN | 103283691 | A | | 9/2013 | |
| CN | 204343163 | U | | 5/2015 | |
| CN | 106524466 | A | | 3/2017 | |
| CN | 207422399 | U | | 5/2018 | |
| JP | 5287549 | | | 9/2013 | |
| KR | 10-0323517 | | | 2/2002 | |
| KR | 2003-0082298 | | | 10/2003 | |
| KR | 10-2005-0089414 | | | 9/2005 | |
| KR | 10-0654729 | | | 12/2006 | |
| KR | 10-2009-0080746 | | | 7/2009 | |
| KR | 1020150137524 | | * | 9/2015 | F24F 1/02 |
| KR | 1020170061375 | | * | 5/2017 | F24F 1/00 |
| KR | 10-2018-0127223 | | | 11/2018 | |

OTHER PUBLICATIONS

Office Action dated May 6, 2023 in Chinese Patent Application No. 202010278631.5.
Notice of Allowance dated Oct. 24, 2023 in Chinese Patent Application No. 202010278631.5.
Office Action dated Nov. 22, 2023 in Korean Patent Application No. 10-2019-0041974.

* cited by examiner

AIR CONDITIONER

CROSS-REFERENCE TO RELATED APPLICATION

This application is based on and claims priority under 35 U.S.C. § 119 to Korean Patent Application No. 2019-0041974, filed on Apr. 10, 2019, in the Korean Intellectual Property Office, the disclosure of which is incorporated herein by reference.

BACKGROUND

1. Field

The disclosure relates to an air conditioner, and more specifically, to an air conditioner having different air discharge methods.

2. Description of the Related Art

An air conditioner is an appliance which controls temperature, humidity, and air current distribution of an indoor space and also eliminates dust from air by using a refrigeration cycle in order to provide a comfortable indoor environment for users. The refrigeration cycle is constructed using a compressor, a condenser, an evaporator, an expansion valve, and a blower fan as major components.

The air conditioner may be classified into a split type air conditioner in which an indoor unit and an outdoor unit are split and individually installed, and an integral type air conditioner in which an indoor unit and an outdoor unit are installed in one cabinet. The split type conditioner includes a heat exchanger to heat exchange with air suctioned into a panel and a blower fan that suctions indoor air into the panel and blows the suctioned air to the indoor space.

As for the indoor unit according to the conventional air conditioner, a user may feel cold and uncomfortable when directly exposed to the discharged air, and may feel hot and uncomfortable without being exposed to the discharged air.

SUMMARY

In accordance with one aspect of the disclosure, an air conditioner includes: a housing; an outlet configured to discharge air introduced into the housing; a discharge panel arranged in front of the outlet and having a plurality of discharge holes that discharge air; and a support member arranged between the outlet and the discharge panel and on which the discharge panel is supported, wherein the support member includes a first frame supporting one side of the discharge panel and extending in a first direction, a second frame supporting an other side of the discharge panel and arranged in parallel with the first frame, and a third frame arranged between the first frame and the second frame and extending in a second direction perpendicular to the first direction, wherein the third frame is formed of a metal material.

The third frame may be arranged to be spaced apart from the discharge panel in a third direction perpendicular to the first direction and the second direction.

The third frame may have a curved line convexly formed in the third direction.

The third frame may have at least a portion thereof in the second direction whose cross section includes a curved line.

The third frame may be formed of a material different from a material forming the first frame and the second frame, and may be formed of a material having a rigidity higher than a rigidity of a material forming the first frame and the second frame.

The third frame may include a coupling portion arranged at one end thereof and provided to be coupled to the first frame or the second frame.

The support member may further include a restraining member configured to restrain the coupling portion onto the first frame or the second frame such that the coupling portion is coupled to the first frame or the second frame.

The first frame may further include a metal material that is inserted into the first frame, and the restraining member is coupled to the metal member.

The coupling portion may include a bent region at which the coupling portion changes from extending in the second direction to extending in the first direction, the restraining member may be inserted into an inner region of the coupling portion that is formed by the bent region so that the coupling portion is restrained onto the first frame or the second frame.

The third frame may further include a curved portion having a curved line convexly formed in the third direction and a connecting portion connecting the curved portion to the coupling portion, wherein the connecting portion may include a first region connected to the curved portion and extending in a direction opposite to a protruding direction of the curved portion and a second region extending from the first region in the second direction and connected to the coupling portion.

The support member may further include: a connection frame connecting the first frame to the second frame and extending in the second direction; and an opening formed by the first frame, the second frame, and the connection frame and opening in a third direction perpendicular to the first direction and the second direction, wherein the opening may be provided to correspond to the outlet in the third direction, and the third frame may be arranged above the opening in the third direction.

The support member may further include a fourth frame arranged between the first frame and the second frame and extending in a direction parallel to the first frame and the second frame.

The support member may further include an intermediate member provided to be arranged between a pair of the coupling portions and the restraining member.

The air conditioner may further include an inlet provided in the housing, a heat exchanger arranged on a flow path formed between the inlet and the discharge panel, and a blower allowing air suctioned through the inlet to be discharged through the discharge panel.

The air conditioner may further include an auxiliary inlet provided in the housing, a guide outlet configured to discharge air introduced through the auxiliary inlet such that the air introduced through the auxiliary inlet is mixed with air discharged from the discharge panel, and an auxiliary blower arranged on a guide flow path formed between the auxiliary inlet and the guide outlet and allowing the air introduced through the auxiliary inlet to be discharged through the guide outlet.

In accordance with another aspect of the disclosure, an air conditioner includes: a housing; an outlet configured to discharge air introduced into the housing; a discharge panel arranged in front of the outlet and having a plurality of discharge holes that discharge air; and a support member arranged between the outlet and the discharge panel and on which the discharge panel is supported, wherein the support member includes a first frame supporting one side of the discharge panel and extending in a first direction, a second frame supporting an other side of the discharge panel and arranged in parallel with the first frame, and a third frame arranged between the first frame and the second frame and extending in a second direction perpendicular to the first direction, wherein the third frame is arranged to be spaced apart from the discharge panel in a third direction perpendicular to the first direction and the second direction.

The third frame may be formed of a metal material.

The third frame may have a curved line convexly formed in the third direction.

The third frame may be formed of a material different from a material forming the first frame and the second frame, and may be formed of a material having a rigidity higher than a rigidity of a material forming the first frame and the second frame.

In accordance with another aspect of the disclosure, an air conditioner includes: a housing having a first inlet and a second inlet; a main outlet formed in the housing to discharge air introduced through the first inlet; a guide outlet configured to discharge air introduced through the second inlet to be mixed with the air discharged through the main outlet; a heat exchanger arranged on a first flow path formed between the first inlet and the main outlet; a first blower arranged to suction air through the first inlet and discharge the suctioned air through the main outlet; a second blower arranged to suction air through the second inlet and discharge the suctioned air through the guide outlet; a discharge panel arranged in front of the main outlet and having a plurality of discharge holes that discharge air; and a support member arranged between the main outlet and the discharge panel and on which the discharge panel is supported, wherein the support member has a curved line convexly formed in a direction toward the discharge panel.

Additional aspects of the disclosure will be set forth in part in the description which follows and, in part, will be obvious from the description, or may be learned by practice of the disclosure.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
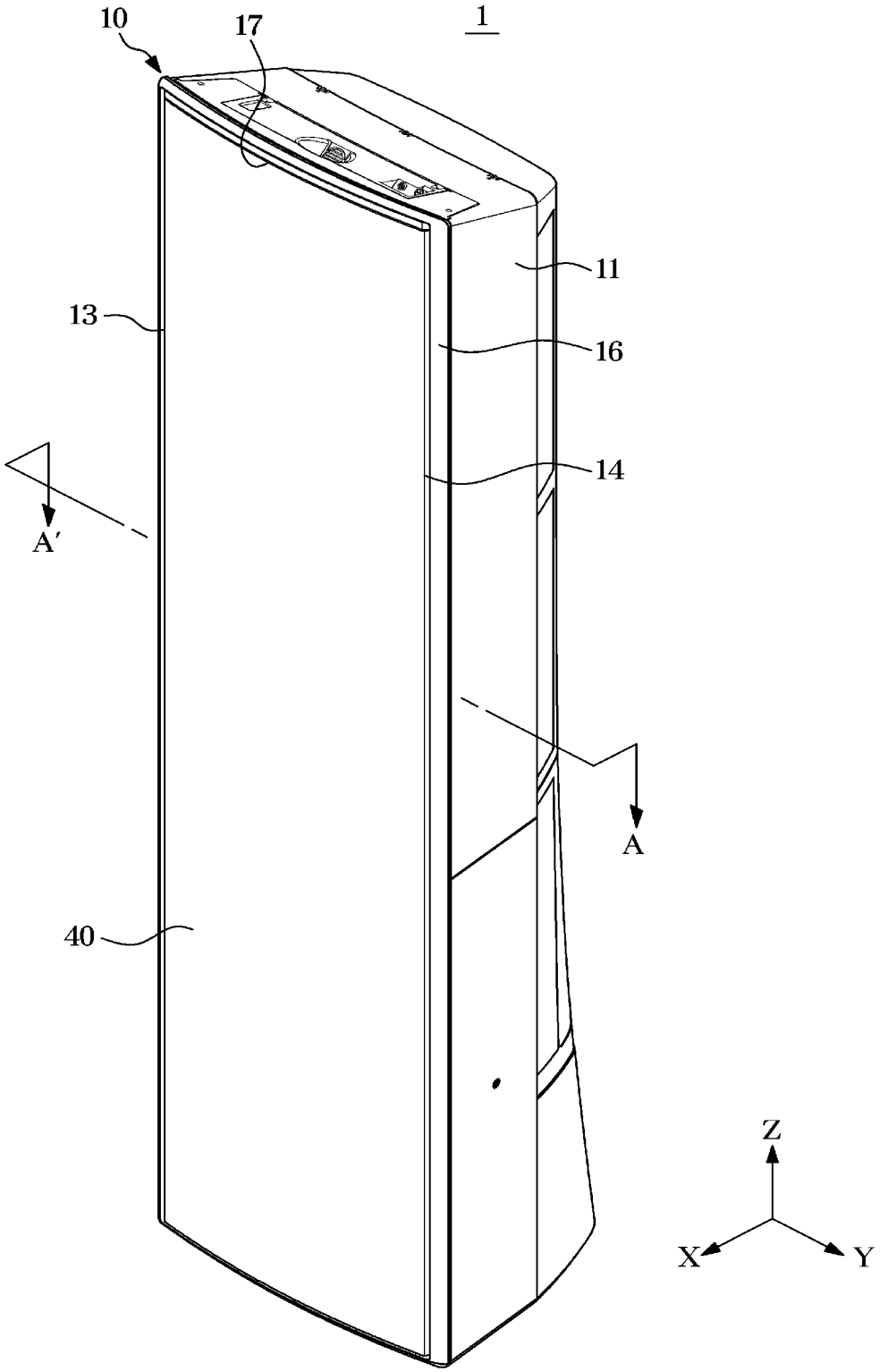
FIG. 1 is a view illustrating an air conditioner according to an embodiment of the disclosure.

The embodiments set forth herein and illustrated in the configuration of the present disclosure are only the most preferred embodiments and are not representative of the full the technical spirit of the present disclosure, so it should be understood that they may be replaced with various equivalents and modifications at the time of the disclosure.

Throughout the drawings, like reference numerals refer to like parts or components.

The terminology used herein is for the purpose of describing particular embodiments only and is not intended to limit the disclosure. It is to be understood that the singular forms "a," "an," and "the" include plural references unless the context clearly dictates otherwise. It will be further understood that the terms "include", "comprise" and/or "have" when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or section discussed below could be termed a second element, component, region, layer or section without departing from the teachings of the disclosure. Descriptions shall be understood as to include any and all combinations of one or more of the associated listed items when the items are described by using the conjunctive term "~ and/or ~," or the like.

The terms "front", "rear", "upper", "lower", "top", and "bottom" as herein used are defined with respect to the drawings, but the terms may not restrict the shape and position of the respective components.

Therefore, it is an object of the disclosure to provide an air conditioner having various air discharge methods.

It is another object of the disclosure to provide a support member effectively supporting a discharge panel for discharging air.

It is another object of the disclosure to provide an air conditioner capable of reducing dew condensation that may occur in a support member.

A refrigeration cycle composing an air conditioner includes a compressor, a condenser, an expansion valve, and an evaporator. The refrigeration cycle is constructed so that a refrigerant circulates through a series of compression-condensation-expansion-evaporation to supply air conditioned through heat exchanged with the refrigerant.

The compressor compresses a refrigerant gas to discharges a high temperature and high pressure refrigerant, and the discharged refrigerant gas is introduced into the condenser. The condenser condenses the compressed refrigerant into a liquid phase refrigerant and in the condensation process, heat is emitted to the surroundings.

The expansion valve expands the high temperature and high pressure liquid refrigerant condensed in the condenser into a low pressure liquid refrigerant. The evaporator evaporates the refrigerant expanded in the expansion valve and returns the low temperature and low pressure refrigerant gas to the compressor. The evaporator may achieve a freezing effect by heat exchange with an object to be cooled using latent heat of evaporation of the refrigerant. Through the cycle, the air conditioner may control the temperature of the indoor space.

An outdoor unit of the air conditioner refers to a part including a compressor and an outdoor heat exchanger in the refrigeration cycle. An indoor unit of the air conditioner includes an indoor heat exchanger, and an expansion valve may be placed on an indoor unit or an outdoor unit. The indoor heat exchanger and the outdoor heat exchanger may serve as a condenser or an evaporator. When the indoor heat exchanger is used as a condenser, the air conditioner becomes a heater, and when the indoor heat exchanger is used as an evaporator, the air conditioner becomes a cooler.

Hereinafter, embodiments according to the disclosure will be described in detail with reference to the accompanying drawings.

Figure 2:
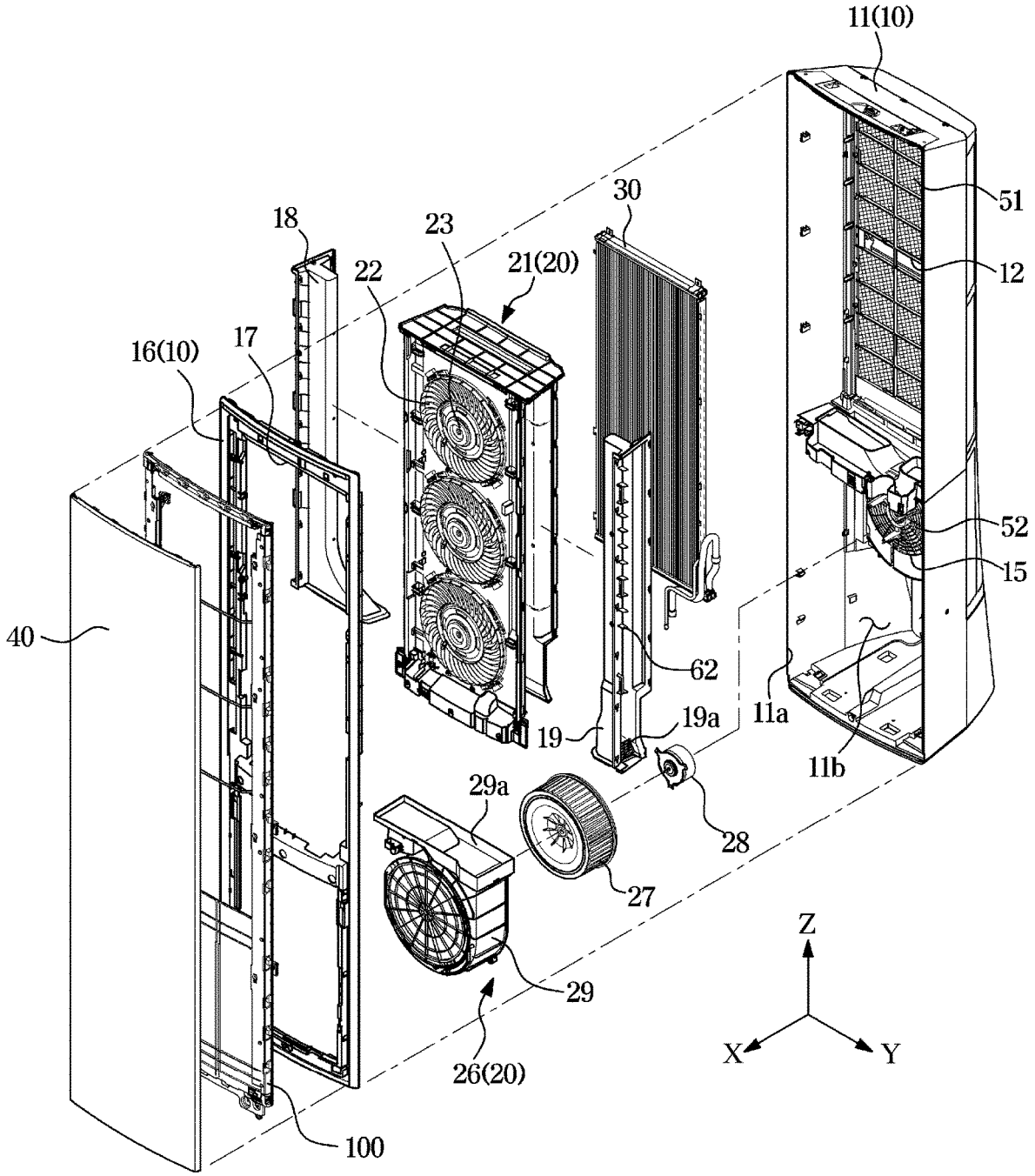
FIG. 2 is an exploded view illustrating the air conditioner shown in FIG. 1.
Figure 3:
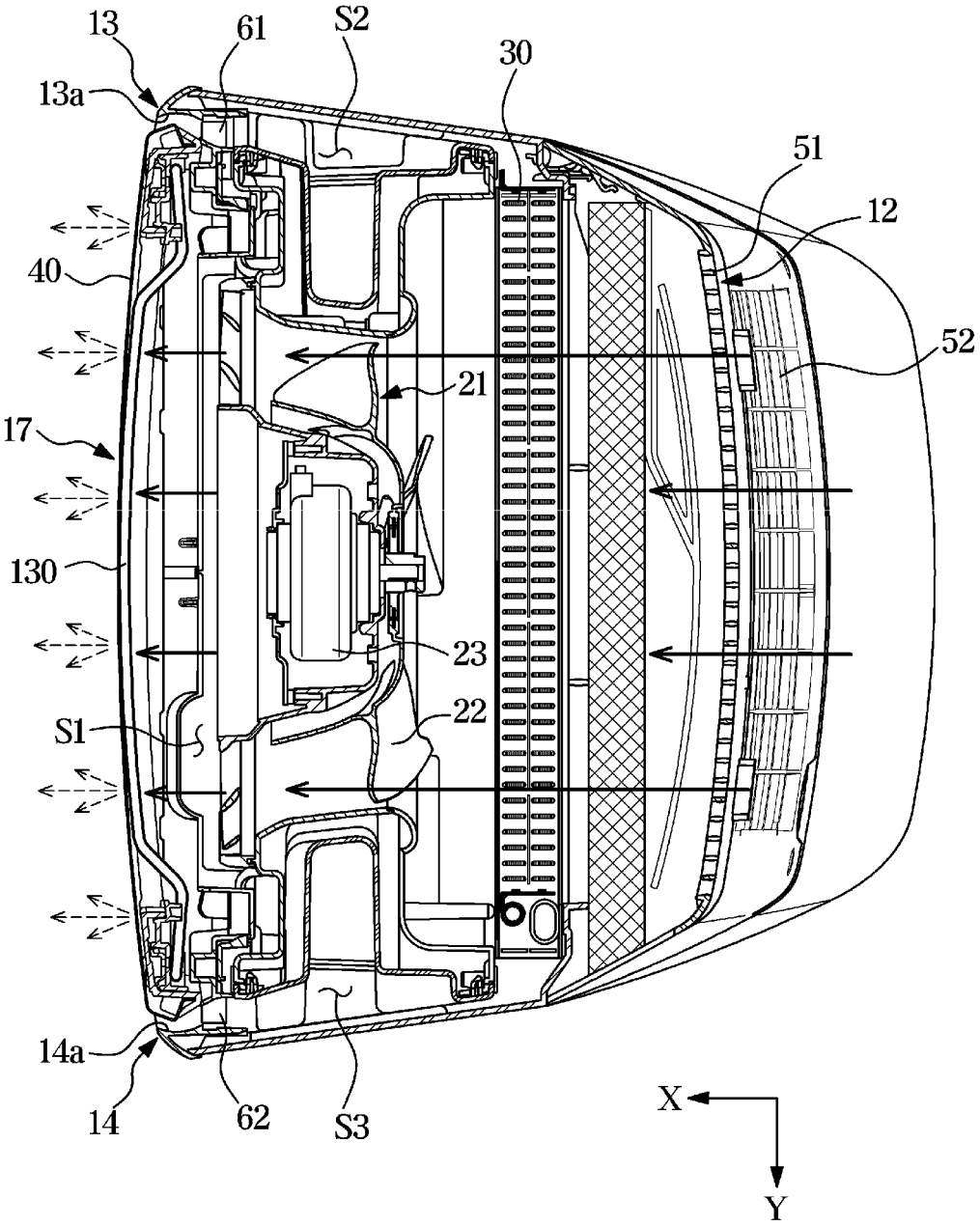
FIG. 3 is a cross-sectional view taken along line A-A' of FIG. 1, which illustrates the air conditioner shown in FIG. 1 operating in the first mode.
Figure 4:
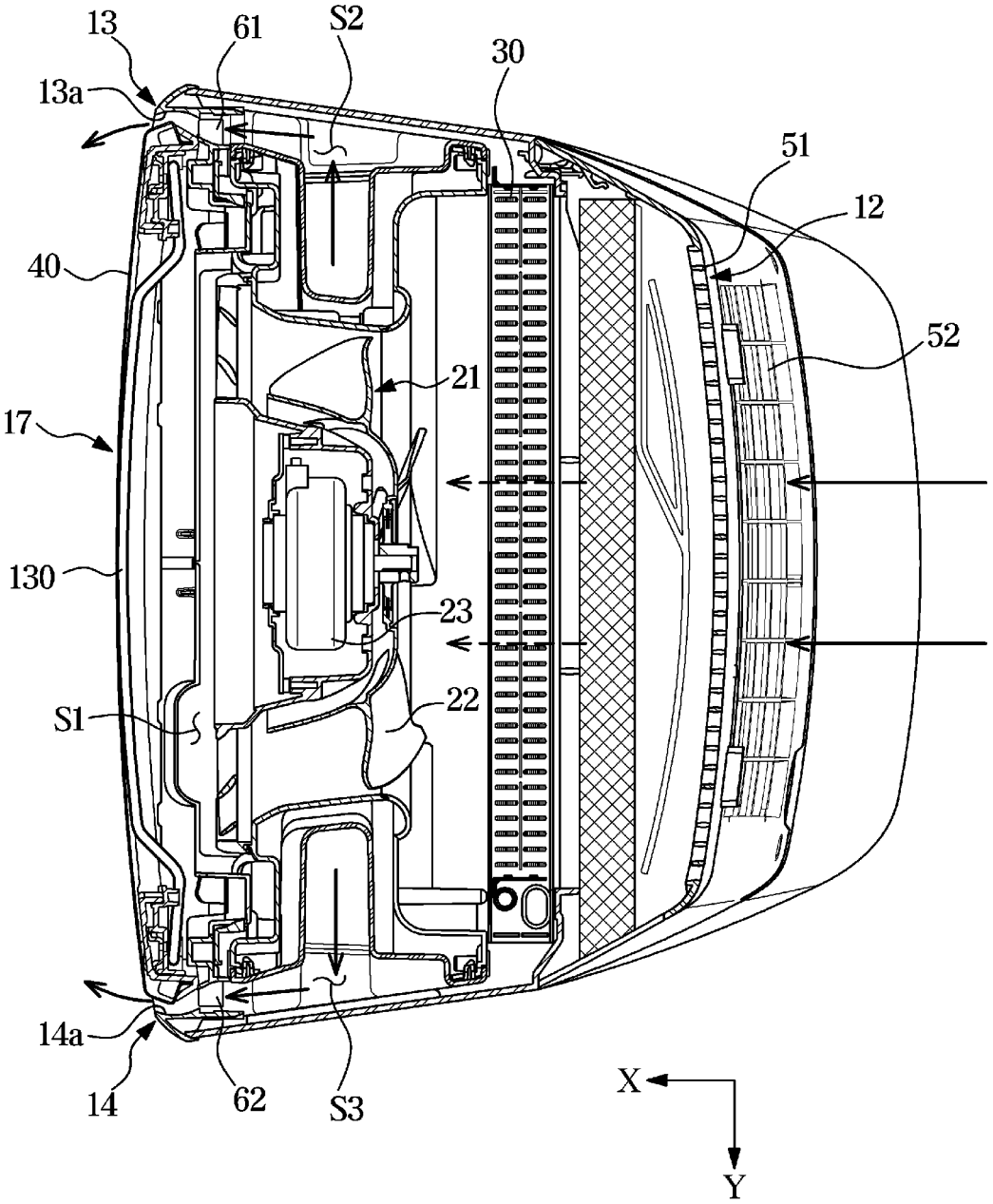
FIG. 4 is a cross-sectional view taken along line A-A' of FIG. 1 which illustrates the air conditioner shown in FIG. 1 operating in the second mode.
Figure 5:
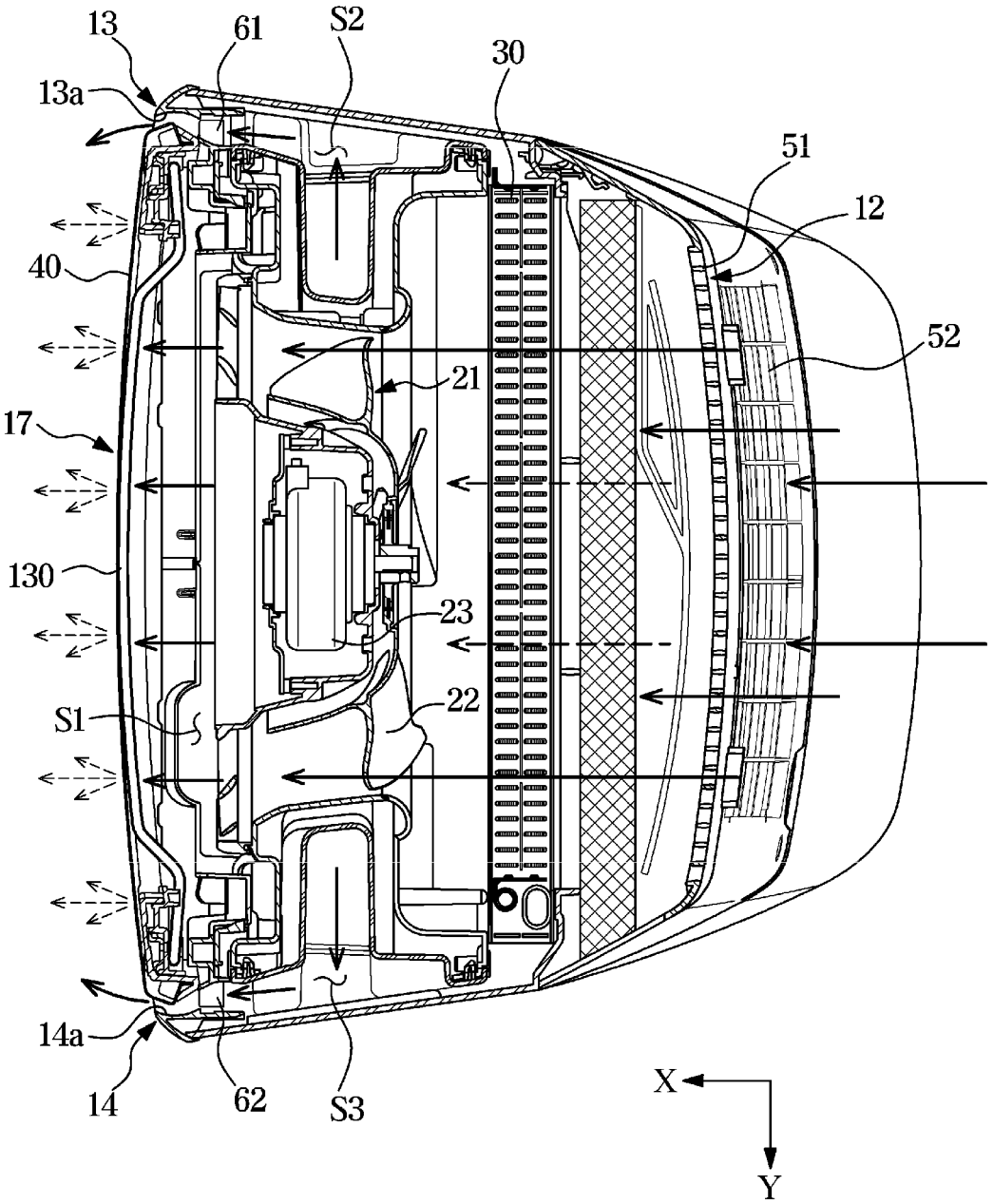
FIG. 5 is a cross-sectional view taken along line A-A' of FIG. 1 which illustrates the air conditioner shown in FIG. 1 operating in the third mode.

FIG. 1 is a view illustrating an air conditioner according to an embodiment of the disclosure, FIG. 2 is an exploded view illustrating the air conditioner shown in FIG. 1, FIG. 3 is a cross-sectional view taken along line A-A' of FIG. 1, which illustrates the air conditioner shown in FIG. 1 operating in the first mode, FIG. 4 is a cross-sectional view taken along line A-A' of FIG. 1 which illustrates the air conditioner shown in FIG. 1 operating in the second mode, and FIG. 5 is a cross-sectional view taken along line A-A' of FIG. 1 which illustrates the air conditioner shown in FIG. 1 operating in the third mode.

Referring to FIGS. 1 and 2, an air conditioner 1 includes a housing 10 forming the external appearance, a blower 20 circulating air to the inside or outside of the housing 10, and a heat exchanger 30 performing heat exchanging with air introduced into the housing 10.

The housing 10 may include a body case 11 on which the blower 20 and the heat exchanger 30 are mounted, and a front panel 16 covering the front surface of the body case 11. The housing 10 may include a first inlet 12, a second inlet 15, a main outlet 17, and guide outlets 13 and 14.

The body case 11 may form a rear surface, both side surfaces, an upper surface, and a bottom surface of the air conditioner 1. The body case 11 has a front surface thereof open, and the open front surface may form a body case opening 11*a* that may be covered by the front panel 16 and a discharge panel 40.

The front panel 16 may be coupled to the body case opening 11*a*. In FIG. 2, the front panel 16 is illustrated as be detachably provided on the body case 11, but the front panel 16 and the body case 11 may be integrally formed with each other.

The main outlet 17 may be formed in the front panel 16. The main outlet 17 may be arranged in the front of the housing 10. The main outlet 17 may pass through the front panel 16. The main outlet 17 may be formed in an upper portion of the front panel 16. The main outlet 17 may be arranged at a position substantially facing the first inlet 12. The air heat exchanged inside the housing 10 may be discharged to the outside of the housing 10 through the main outlet 17. The main outlet 17 may allow air introduced through the first inlet 12 to be discharged to the outside.

The air conditioner 1 may include a support member 100 for supporting the discharge panel 40. The support member 100 will be described below in detail.

The body case 11 may be provided with the first inlet 12. The first inlet 12 may pass through the rear surface of the body case 11. The first inlet 12 may be formed in an upper portion of the rear surface of the body case 11. Outside air may be introduced into the housing 10 through the first inlet 12.

Although the first inlet 12 is illustrated as being provided in two units thereof in FIG. 2, the number of the first inlets 12 is not limited thereto, and the first inlet 12 may be variously provided as needed. Although the first inlet 12 is illustrated in a quadrangular shape, the shape of the first inlet 12 is not limited thereto and may be variously formed as needed.

The body case 11 is provided with the second inlet 15. The second inlet 15 may pass through the rear surface of the body case 11. The second inlet 15 may be formed in a lower portion of the rear surface of the body case 11. The second inlet 15 may be formed below the first inlet 12. Outside air may be introduced into the housing 10 through the second inlet 15.

Similar to the first inlet 12, the number and/or shape of the second inlet 15 may be provided in various forms as needed.

The front panel 16 may form the guide outlets 13 and 14 together with the discharge panel 40. The guide outlets 13 and 14 may be formed on the same surface as the main outlet 17. The guide outlets 13 and 14 may be formed on the left and/or right side of the main outlet 17. The guide outlets 13 and 14 may be arranged adjacent to the main outlet 17. The guide outlets 13 and 14 may be disposed to be spaced apart from the main outlet 17 by a predetermined interval. The guide outlets 13 and 14 may include a first guide outlet 13 disposed on the left side of the main outlet 17 and a second guide outlet 14 disposed on the right side of the main outlet 17.

The guide outlets 13 and 14 may extend in an upper side and lower side direction of the body case 11. The guide outlets 13 and 14 may have a length approximately equal to the length of the main outlet 17. Air that is not heat exchanged inside the housing 10 may be discharged to the outside of the housing 10 through the guide outlets 13 and 14. The guide outlets 13 and 14 may allow air introduced through the second inlet 15 to be discharged to the outside.

The guide outlets 13 and 14 may be configured to mix the air discharged from the guide outlets 13 and 14 with the air discharged from the main outlet 17. In detail, a part of the front panel 16 forming the guide outlets 13 and 14 may include a guide curved portions (13*a* and 14*a* in FIG. 3) for guiding air discharged from the guide outlets 13 and 14 such that the air discharged from the guide outlets 13 and 14 is mixed with the air discharged from the main outlet 17.

The air discharged through the guide outlets 13 and 14 may be discharged along the guide curved portions 13*a* and 14*a* to a side in which air discharged through the guide outlets 13 and 14 is mixed with the air discharged from the main outlet 17. The guide curved portions 13*a* and 14*a* may guide the air discharged through the guide outlets 13 and 14 to be discharged in the substantially same direction as the air discharged through the main outlet 17. The guide curved portions 13*a* and 14*a* may be provided to guide the air discharged through the guide outlets 13 and 14 to the front.

On the guide outlets 13 and 14, blades (61 and 62 in FIG. 3) for guiding air discharged through the guide outlets 13 and 14 may be provided. The blades 61 and 62 may be continuously arranged along the longitudinal direction of the guide outlets 13 and 14. A first blade 61 may be disposed on the first guide outlet 13, and a second blade 62 may be disposed on the second guide outlet 14.

An air flow path connecting the first inlet 12 to the main outlet 17 is referred to as a first flow path S1, and an air flow path connecting the second inlet 15 to the first guide outlet 13 is referred to as a second flow path S2, and an air flow path connecting the second inlet 15 to the second guide outlet 14 is referred to as a third flow path S3. Here, the first flow path S1 may be divided from the second flow path S2 and the third flow path S3. Accordingly, the air flowing through the first flow path S1 may not be mixed with the air flowing through the second flow path S2 and the third flow path S3. Some sections of the second flow path S2 and the third flow path S3 may overlap. Specifically, the second flow path S2 and the third flow path S3 may share a section from the second inlet 15 to a second blower 26.

Disposed inside the housing 10 may be a first duct 18 that divides the first flow path S1 from the second flow path S2. The first duct 18 may be disposed on the left side of a first blower 21. The first duct 18 may extend in the upper side and lower side direction. The first duct 18 may communicate with the second blower 26. The first duct 18 may communicate with a fan outlet 29*a* of the second blower 26. The first duct 18 may guide part of the air blown by the second blower 26 to the first guide outlet 13. The first duct 18 may be provided with a first duct filter (not shown) to filter out foreign matters from the air flowing from the second blower 26.

Disposed inside the housing 10 may be a second duct 19 that divides the first flow path S1 and the third flow path S3 from each other. The second duct 19 may be disposed on the right side of the first blower 21. The second duct 19 may extend along the upper side and right side direction. The second duct 19 may communicate with the second blower 26. The second duct 19 may communicate with the fan outlet 29*a* of the second blower 26. The second duct 19 may guide part of the air blown by the second blower 26 to the second guide outlet 14. The second duct 19 may be provided with a second duct filter 19*a* to filter out foreign matters from the air introduced from the second blower 26.

The air conditioner 1 may allow air heat exchanged with the heat exchanger 30 to be discharged through the main outlet 17, and allow air not passing through the heat exchanger 30 to be discharged through the guide outlets 13 and 14.That is, the guide outlets 13 and 14 may be provided to discharge air having no heat exchanged. Since the heat exchanger 30 is disposed on the first flow path S1, air discharged through the main outlet 17 may be heat exchanged air. Since the heat exchanger 30 is not disposed on the second flow path S2 and the third flow path S3, air discharged through the guide outlets 13 and 14 may be air having no heat exchanged.

In contrast, the disclosure may be provided such that heat exchanged air is discharged through the guide outlets 13 and 14. That is, a heat exchanger may be disposed on the second flow path S2 and the third flow path S3. Specifically, a heat exchanger for heat exchanging air that is to be discharged through the guide outlets 13 and 14 may be disposed in an accommodation space 11*b* of the body case 11. With such a configuration, the air conditioner 1 may provide the heat exchanged air through both the main outlet 17 and the guide outlets 13 and 14.

The body case 11 may have a shape in which a cross section along the horizontal direction becomes wider toward the lower side. With such a shape, the housing 10 may be stably supported on the floor.

The body case 11 may be provided at an inside with the accommodation space 11*b* in which electric components (not shown) may be disposed. In the accommodation space 11*b*, electric components required for driving the air conditioner 1 may be disposed. The second blower 26 may be disposed in the accommodation space 11*b*.

The blower 20 may include the first blower 21 and the second blower 26. The second blower 26 may be provided to be driven independently of the first blower 21. The rotational speed of the second blower 26 may be provided to be different from the rotational speed of the first blower 21.

The first blower 21 may be disposed on the first flow path S1 formed between the first inlet 12 and the main outlet 17. The first blower 21 may allow air to be introduced into the housing 10 through the first inlet 12. The air introduced through the first inlet 12 may move along the first flow path S1 and then be discharged to the outside of the housing 10 through the main outlet 17. The first blower 21 may include a first fan 22 and a first fan driver 23.

The first fan 22 may be provided using an axial fan or a mixed flow fan. However, the type of the first fan 22 is not limited thereto, and the first fan 22 may be variously provided as long as it can allow air flowing from the outside of the housing 10 to be discharged again to the outside of the housing 10. For example, the first fan 22 may include a cross fan, a turbo fan, a sirocco fan.

In FIG. 2, the first fan 22 is provided in three units thereof, but the number of first fans 22 is not limited thereto and may be provided in various numbers as needed.

The first fan driver 23 may drive the first fan 22. The first fan driver 23 may be disposed at the center of the first fan 22. The first fan driver 23 may include a motor.

The second blower 26 may be disposed on the second flow path S2 and the third flow path S3 formed between the second inlet 15 and the guide outlets 13 and 14. The second blower 26 may allow air to be introduced into the housing 10 through the second inlet 15. Some of the air introduced through the second inlet 15 moves along the second flow path S2 to be discharged to the outside of the housing 10 through the first guide outlet 13 or moves along the third flow path S3 to be discharged to the outside of the housing 10 through the second guide outlet 14.

The second blower 26 may include a second fan 27, a second fan driver 28, and a fan body case 29.

The second fan 27 may be provided using a centrifugal fan. However, the type of the second fan 27 is not limited thereto, and the second fan 27 may be variously provided as long as it can cause air introduced from the outside of the housing 10 to be discharged again to the outside of the housing 10. For example, the second fan 27 may be provided using a cross fan, a turbo fan, a sirocco fan.

In FIG. 2, the second fan 27 is provided in a single unit thereof, but the number of the second fans 27 is not limited thereto, and may be provided in various numbers as needed.

The second fan driver 28 may drive the second fan 27. The second fan driver 28 may be disposed at the center of the second fan 27. The second fan driver 28 may include a motor.

The fan body case 29 may cover the second fan 27. The fan body case 29 may include a fan inlet (not shown) through which air is introduced, and a fan outlet 29*a* through which air is discharged. The fan inlet and the fan outlet 29*a* may be formed at positions determined corresponding to the type of the second fan 27.

The heat exchanger 30 may be disposed between the first blower 21 and the first inlet 12. The heat exchanger 30 may be disposed on the first flow path 51. The heat exchanger 30 may absorb heat from the air introduced through the first inlet 12 or transfer heat to the air introduced through the first inlet 12. The heat exchanger 30 may include a tube and a header coupled to the tube. However, the type of the heat exchanger 30 is not limited thereto.

The air conditioner 1 may include the discharge panel 40 disposed at a portion of the front panel 16 in which the main outlet 17 is formed. The discharge panel 40 may have a plurality of discharge holes that allows air discharged from the main outlet 17 to be discharged at a speed lower than that of air discharged from the guide outlets 13 and 14. The plurality of discharge holes may be formed to pass through an inner surface and an outer surface of the discharge panel 40. The plurality of discharge holes may be formed in a fine size. The plurality of discharge holes may be uniformly distributed over the entire area of the discharge panel 40. The plurality of discharge holes allow the heat exchanged air discharged through the main outlet 17 to be uniformly discharged at a low speed.

The plurality of discharge holes may be formed in the entire area of the discharge panel 40. However, the disclosure is not limited thereto, and a blocking portion in which a plurality of discharge holes are not formed may be provided in any region of the discharge panel 40.

The air conditioner 1 may include a first suction grille 51 coupled to a portion of the body case 11 in which the first inlet 12 is formed. The first suction grille 51 may be provided to prevent foreign matter from being introduced through the first inlet 12. To this end, the first suction grille 51 may include a plurality of slits or holes. The first suction grills 51 may be provided to cover the first inlet 12.

The air conditioner 1 may include a second suction grille 52 coupled to a portion of the body case 11 in which the second inlet 15 is formed. The second suction grille 52 may be provided to prevent foreign substances from being introduced through the second inlet 15. To this end, the second suction grille 52 may include a plurality of slits or holes. The second suction grille 52 may be provided to cover the second inlet 15.

The air conditioner 1 may include a discharge grille (not shown) coupleable to a portion of the front panel 16 in which the first outlet 17 is formed. The discharge grille may be mounted on a panel support member (not shown). The discharge grill may be provided to prevent foreign matter from being discharged through the first outlet 17. To this end, the discharge grille may include a plurality of slits or holes. The discharge grille may be provided to cover the first outlet 17.

Referring to FIGS. 3 to 5, the driving of the air conditioner 1 will be described.

First, referring to FIG. 3, the air conditioner 1 may be driven in a first mode for discharging the heat exchanged air only through the main outlet 17. Since the discharge panel 40 is disposed on the main outlet 17, the air conditioning may be slowly performed in the entire indoor space. That is, when air is discharged to the outside of the housing 10 through the main outlet 17, the air is reduced in wind speed by passing through the plurality of discharge holes of the discharge panel 40 and thus is discharged at a low speed. With such a configuration, the user may cool or heat the indoor space at a wind speed in which the user feels comfortable.

Specifically, as the first blower 21 is driven, external air of the housing 10 may be introduced into the housing 10 through the first inlet 12. Air introduced into the housing 10 may be heat exchanged by passing through the heat exchanger 30. The air having heat exchanged by passing through the heat exchanger 30 is reduced in speed while passing through the discharge panel 40 via the first blower 21, and is discharged to the outside of the housing 10 through the main outlet 17 at a reduced speed. That is, the heat-exchanged air discharged through the first flow path 51 may be discharged at a wind speed in which the user may feel comfortable.

Since the second blower 26 is not driven in the first mode, air is not discharged through the guide outlets 13 and 14.

Referring to FIG. 4, the air conditioner 1 may be driven in a second mode for discharging air that is not heat exchanged, only through the guide outlets 13 and 14. Since a heat exchanger is not disposed on the second flow path S2 and the third flow path S3, the air conditioner 1 may circulate indoor air.

Since the guide curved portions 13*a* and 14*a* are provided on the guide outlets 13 and 14, air discharged through the guide outlets 13 and 14 may be discharged to the front of the air conditioner 1. Since the blades 61 and 62 are provided on the guide outlets 13 and 14, air may be blown farther toward the front.

Specifically, as the second blower 26 is driven, external air of the housing 10 may be introduced into the housing 10 through the second inlet 15. The air introduced into the housing 10 passes through the second blower 26 and moves to the second flow path S2 and the third flow path S3 formed on both sides of the first flow path 51, respectively. The air may flow upward in the second flow path S2 and the third flow path S3, and may be discharged to the outside of the housing 10 through the guide outlets 13 and 14. In this case, the air may be guided toward the front of the air conditioner 1 along the guide curved portions 13*a* and 14*a*.

In the second mode, since the first blower 21 is not driven, air is not discharged through the main outlet 17. That is, in the second mode, the air conditioner 1 blows air that is not heat exchanged, so that the air conditioner 1 may simply perform a function of circulating indoor air or provide a strong wind to the user.

Referring to FIG. 5, the air conditioner 1 may be driven in a third mode for discharging heat exchanged air through the main outlet 17 and the guide outlets 13 and 14. The air conditioner 1 driven in the third mode may discharge cold air at a farther distance when compared to when driven in the first mode.

Specifically, when the air conditioner 1 is driven in the third mode, cold air or warm air discharged through the main outlet 17 and air discharged through the guide outlets 13 and 14 may be mixed. In addition, the air discharged through the guide outlets 13 and 14 is discharged at a higher speed than the air discharged through the main outlet 17, so that the air discharged through the guide outlets 13 and 14 allows the air discharged through the main outlet 17 to be moved at a farther distance.

With such a configuration, the air conditioner 1 may provide a user with pleasant cold or warm air in which heat-exchanged air and indoor air are mixed.

In addition, the air conditioner 1 may be provided to change the driving force of the first blower 21 and/or the second blower 26 to provide cold air at various distances. That is, the first blower 21 may be configured to adjust the air volume and/or the wind speed of air discharged through the main outlet 17, and the second blower 26 may be configured to adjust the air volume and/or the wind speed of air discharged through the guide outlets 13 and 14.

For example, by increasing the driving force of the second blower 26 to increase the air volume and/or the wind speed of the air discharged from the guide outlets 13 and 14, the air conditioner 1 may allow the heat exchanged air to be moved at a farther distance. On the other hand, by reducing the driving force of the second blower 26 to reduce the air volume and/or the wind speed of the air discharged from the guide outlets 13 and 14, the air conditioner 1 may provide the heat exchanged air at a closer distance.

Hereinafter, the support member 100 supporting the discharge panel 40 will be described in detail.

Figure 6:
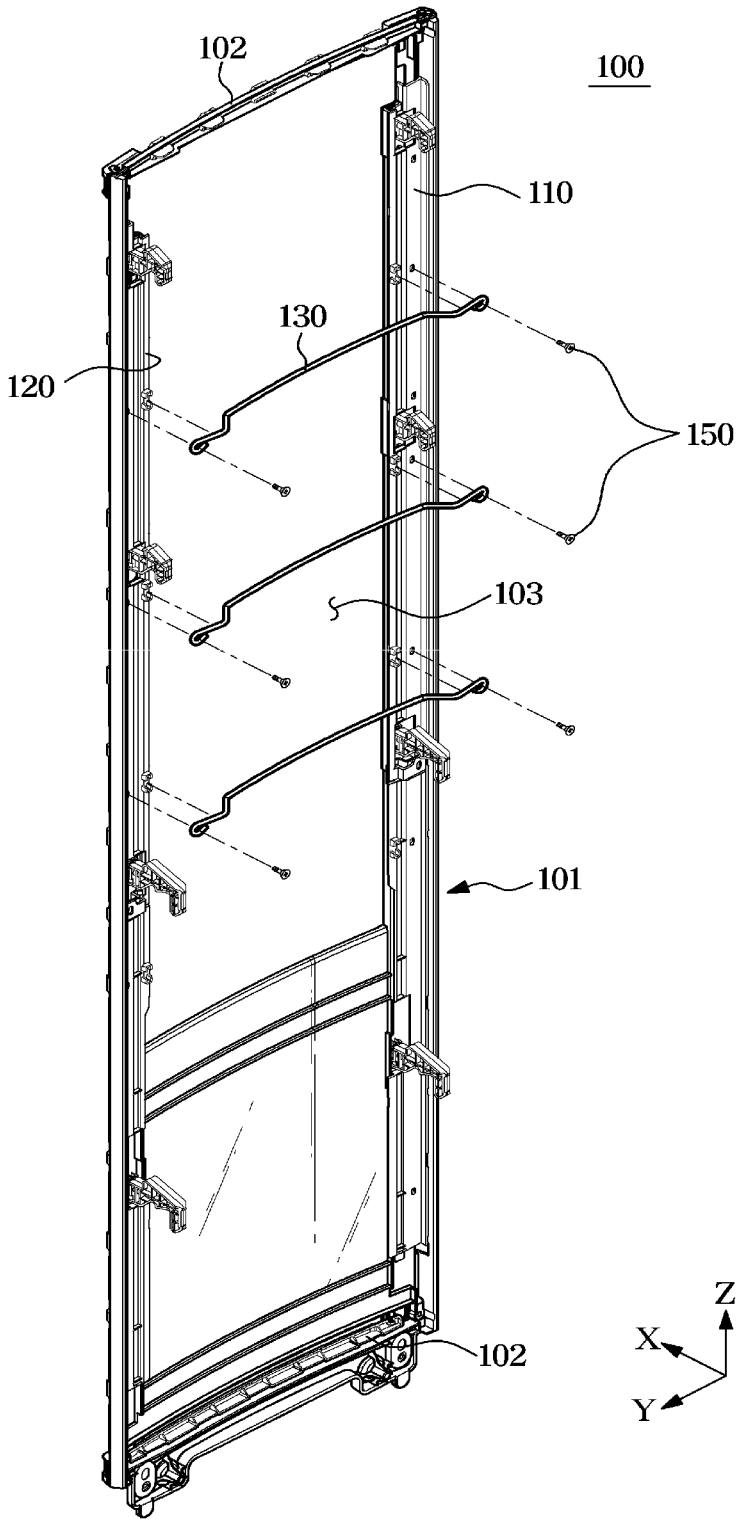
FIG. 6 is an exploded perspective view illustrating components of a support member of the air conditioner according to the embodiment of the disclosure.
Figure 7:
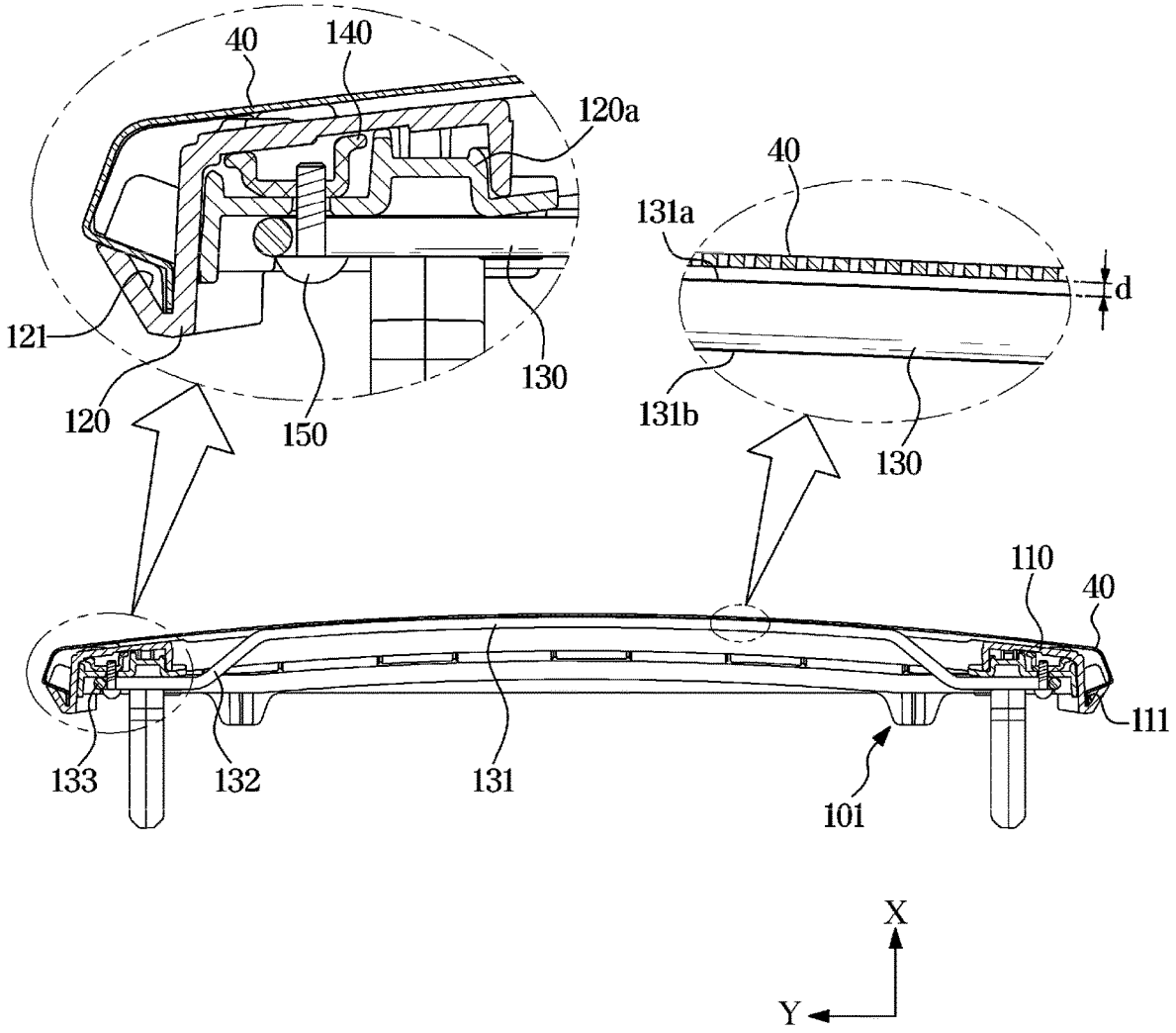
FIG. 7 is a cross-sectional view illustrating a part of the air conditioner illustrated in FIG. 1.
Figure 8:
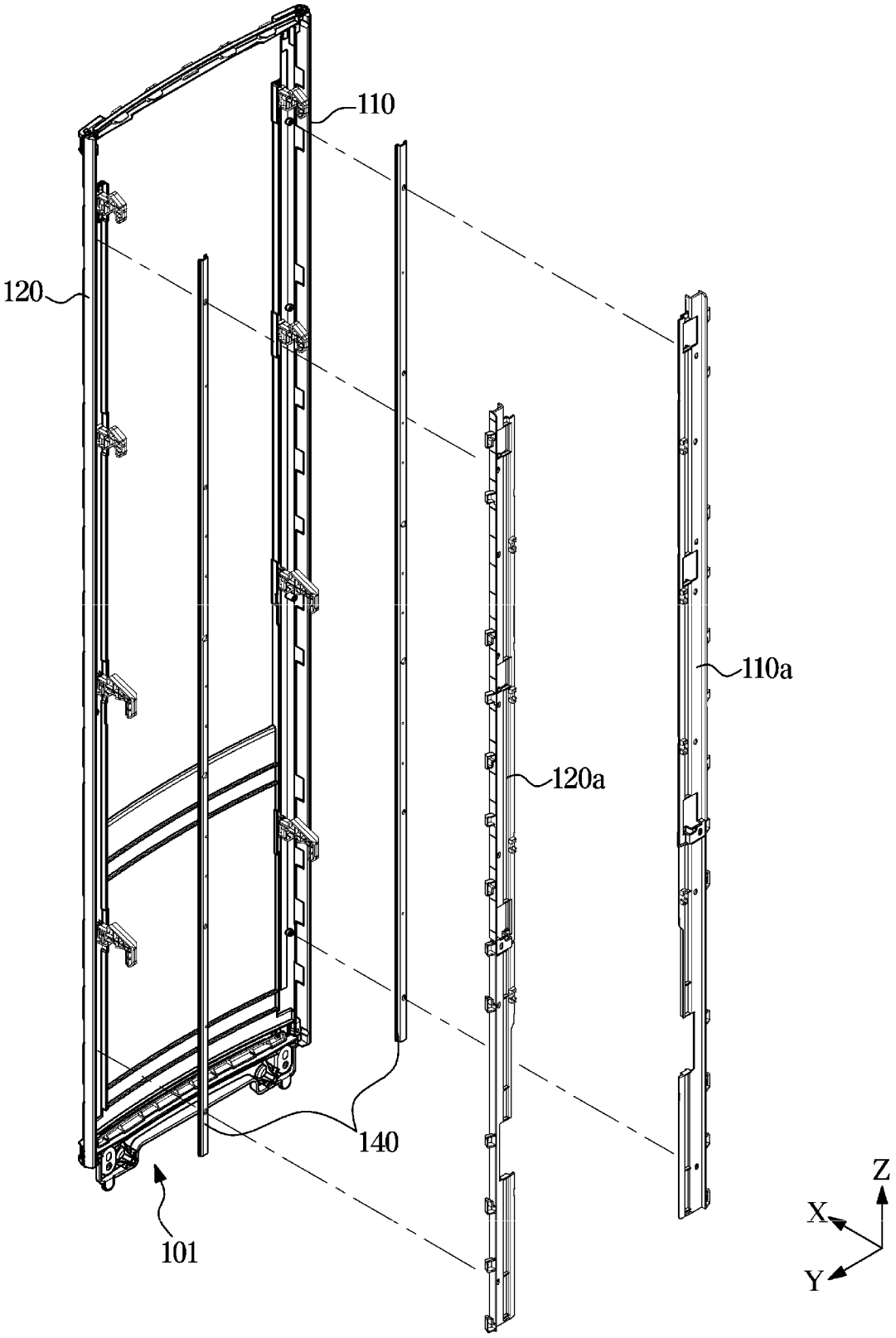
FIG. 8 is an exploded perspective view illustrating components of the support member of the air conditioner according to the embodiment of the disclosure.
Figure 9:
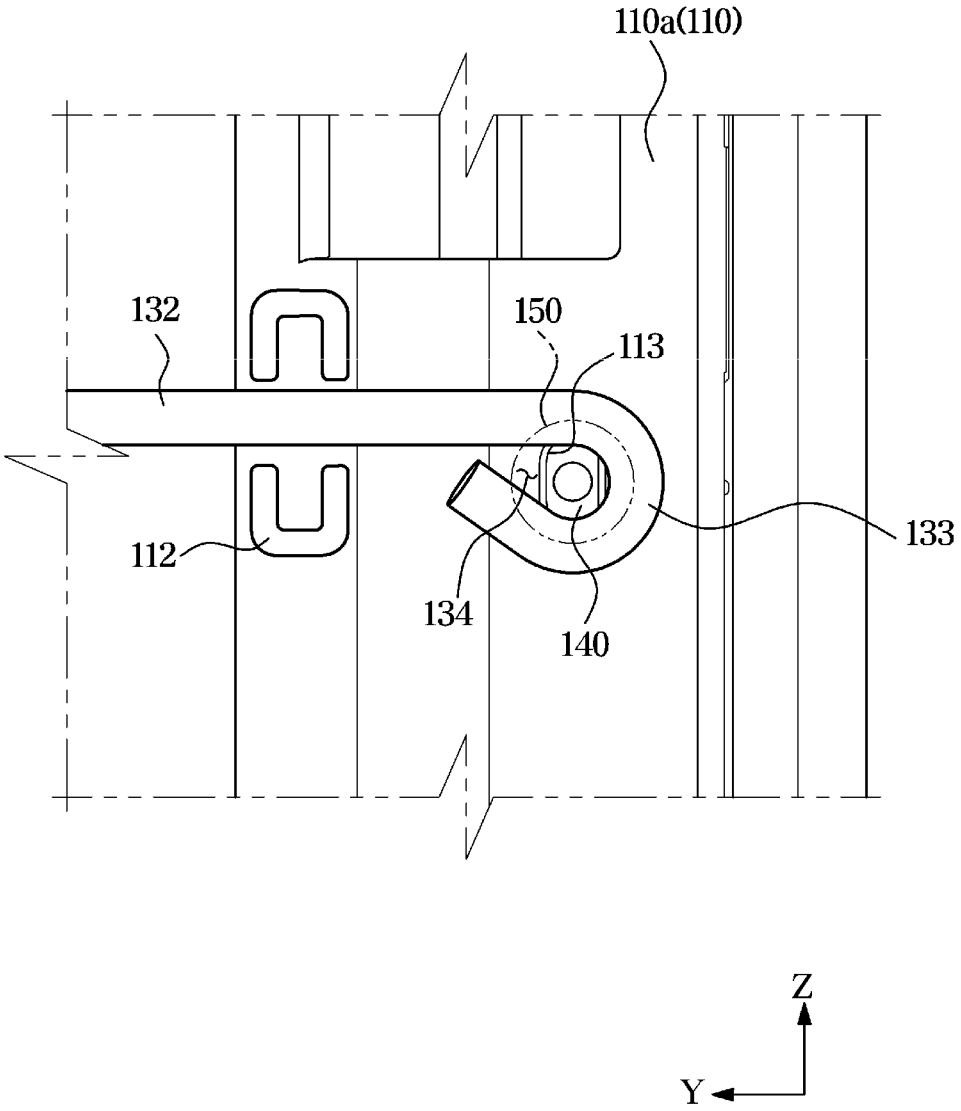
FIG. 9 is an enlarged view of a part of the support member of the air conditioner according to the embodiment of the disclosure.

FIG. 6 is an exploded perspective view illustrating components of a support member of the air conditioner according to the embodiment of the disclosure, FIG. 7 is a cross-sectional view illustrating a part of the air conditioner illustrated in FIG. 1, FIG. 8 is an exploded perspective view illustrating components of the support member of the air conditioner according to the embodiment of the disclosure, and FIG. 9 is an enlarged view of a part of the support member of the air conditioner according to the embodiment of the disclosure.

As described above, the support member 100 may support the discharge panel 40. As shown in FIG. 2, the support member 100 may be disposed between the front panel 16 in which the main outlet 17 is formed and the discharge panel 40 in the front-rear direction X.

The support member 100 may be disposed between the main outlet 17 and the plurality of holes of the discharge panel 40 in the front-rear direction X. That is, the support member 100 may be provided to support the discharge panel 40 at a front of the main outlet 17.

The support member 100 may be coupled to the front panel 16. The support member 100 may be provided in a shape substantially corresponding to the front panel 16.

In the case of a conventional air conditioner including a discharge panel, a structure supporting the discharge panel causes an issue because air is discharged from the panel itself. The discharge panel is provided such that the edge of the discharge panel is supported by a support member to prevent a discharge flow path formed behind the discharge panel from being restricted.

Accordingly, there is no member supporting the discharge panel at an inner side of the edge of the discharge panel, so the shape of the discharge panel is deformed when the discharge panel is pressed by an external force.

That is, the discharge panel is formed of a metal material. When the discharge panel is pressed by an external force, the shape may be deformed. When the shape is deformed in a certain range, the shape may be restored to the original shape by the elasticity of the metal material. However, when the discharge panel is deformed to a degree outside a certain range by an external force, the shape may be permanently deformed without being restored to the original shape.

In order to prevent such a permanent deformation, the conventional support member for the air conditioner including the discharge panel includes a support rib provided behind the discharge panel so that the shape of the discharge panel is restored when the shape of the discharge panel is deformed by an external force.

The support ribs may be provided in a thin rib shape to minimize the restriction of the air flow in the discharge flow path formed behind the discharge panel. In addition, the conventional support ribs are formed mainly of plastic injection molding.

When the discharge panel is pressed by an external force, the support rib disposed behind the discharge panel prevents the shape of the discharge panel from being deformed to a degree more than a predetermined range, and thus the shape of the discharge panel may be easily restored.

However, in the conventional support ribs, when the discharge panel is pressed by an external force of a predetermined magnitude or more, the discharge panel may be deformed, or due to its high brittleness as being formed of an injection molding, may be broken.

In addition, since the support ribs are provided to come into contact with the rear surface of the discharge panel, dew condensation occurs in a portion where the support ribs come into contact with the discharge panel.

The air conditioner 1 according to the embodiment of the disclosure includes the support member 100 that may obviate the above described limitations.

As shown in FIGS. 6 and 7, the support member 100 includes a first frame 110 supporting one side of the discharge panel 40 and extending in a first direction Z, which is an upper side and lower side direction, a second frame 120 supporting the other side of the discharge panel 40 and disposed to be horizontally spaced apart from the first frame 110 in a second direction Y which is substantially perpendicular to the first direction Z, that is, a left and right side direction.

The support member 100 may include a frame body 101. The first frame 110 and the second frame 120 may be provided as a part of the frame body 101. That is, the first frame 110 and the second frame 120 may be integrally formed with each other. However, the disclosure is not limited thereto, and the first frame 110 and the second frame 120 may be provided separately from each other.

The first frame 110 and the second frame 120 may be provided to support the left side and the right side of the discharge panel 40, respectively, such that the discharge panel 40 may be coupled to the housing 10.

As described above, since the support member 100 is coupled to the front panel 16, the discharge panel 40 may be coupled to the housing 10 by the support member 100.

The first frame 110 may include a first inserting portion 111 into which a left end of the discharge panel 40 is inserted. The second frame 120 may include a second inserting portion 121 into which a right end of the discharge panel 40 is inserted.

The left and right ends of the discharge panel 40 may be inserted into the first inserting part 111 and the second inserting part 121, respectively, to be supported by the first frame 110 and the second frame 120.

The support member 100 may include a connection frame 102 connecting the first frame 110 to the second frame 120 in the second direction Y. The connection frame 102 may be provided as a part of the frame body 101. However, the disclosure is not limited thereto, and the connection frame 102 may be formed as a separate unit.

The connection frame 102 may be provided to connect upper ends and lower ends of the first frame 110 and the second frame, by which the flow of air inside the air conditioner 1 is prevented from being restricted. However, the disclosure is not limited thereto, and the connection frame 102 may be provided to connect other portions except for the upper and lower ends of the first frame 110 and the second frame 120.

The connection frame 102 may be provided to additionally support the upper side and the lower side of the discharge panel 40. Upper side and lower side ends of the discharge panel 40 may each be coupled to the connection frame 102.

The first frame 110, the second frame 120, and the connection frame 102 may form an opening 103 at an inner side the support member 100 that is open in the front-rear direction X.

The opening 103 of the support member 100 may be disposed between the plurality of holes of the discharge panel 40 and the main outlet 17. That is, the opening 103 of the support member 100 may form at least a portion of the first flow path S1. Preferably, the main outlet 17 and the opening 103 of the support member 100 are disposed at positions corresponding to each other in a third direction X, and the main outlet 17 and the opening 103 of the support member 100 are provided to have areas approximately corresponding to each other.

The support member 100 may include a third frame 130 arranged between the first frame 110 and the second frame 120 in the second direction Y and extending in the second direction Y.

In detail, the third frame 130 may be disposed in the opening 103 of the support member 100. That is, the third frame 130 may be disposed on the first flow path S1.

The third frame 130 may be provided in plurality. The plurality of third frames 130 may be spaced apart from each other in the first direction Z. However, the disclosure is not limited thereto, and the third frame 130 may be provided as a single unit.

The number of the third frames 130 may be variously provided according to the air volume of the first blower 21 determined according to the output of the first fan 22 or the number of the first fans 22.

The number of third frames 130 may be determined to minimize vortices that may be generated near the third frame 130 by the air volume of the first blower 21 while minimizing flow velocity unevenness on the first flow path S1 that may occur in the first direction Z.

According to one embodiment of the disclosure, as shown in FIG. 6, the third frames 130 may be provided as three units.

The three third frames 130 are all provided in the same shape and are coupled to the frame body 101 in the same manner, and only one third frame 130 will be described in order to avoid redundant description.

The third frame 130 may be formed of a metal material.

As described above, the conventional support ribs corresponding to the third frame 130 are formed of a plastic injection molding, and thus, a large number of support ribs are disposed in a lattice shape because of the weak rigidity.

As a result, a part of the flow of air to be discharged to the discharge panel is restricted, and even when a large number of support ribs are disposed, the support ribs may be broken due to the high brittleness thereof because of being formed of injection molding.

However, the third frame 130 of the air conditioner 1 according to the disclosure may be formed of a metal material, so that even a small number of the third frames 130 may maintain at least a certain rigidity. Accordingly, the flow of air on the first flow path S1 may be improved, and even when the discharge panel 40 is pressed by a high external force, the third frame 130 may support the discharge panel 40 to improve the restoring force of the discharge panel 40.

The third frame 130 may be formed of a material having a rigidity higher than that of the first frame 110 or the second frame 120. The third frame 130 may be formed of a material different from that of the first frame 110 or the second frame 120.

The first frame 110 or the second frame 120 may be formed of a plastic injection molding. The third frame 130 may be formed of a metal material, preferably steel, so that the third frame 130 may have a rigidity stronger than that of the first frame 110 or the second frame 120.

The third frame 130 may be provided in a shape of a metal bar extending in the second direction Y and bent at a portion. The third frame 103 may be formed by bending a partial section of a cylindrical bar.

The third frame 103 may be coupled to a rear side of the frame body 101. The third frame 103 may be coupled to the frame body 101 by a restraining member 150. This will be described below in detail.

The third frame 130 may include a region having a curved line 131*a* that is convexly formed in a direction toward the discharge panel 40.

The curved line 131*a* may be provided forward relative to other portions of the third frame 130 in the third direction X, which is the front-rear direction of the air conditioner 1.

In detail, the third frame 130 may include a curved portion 131 having a curved line 131*a* that is convexly formed in the direction toward the discharge panel 40.

The curved portion 131 may be provided in a shape extending along the curved line 131*a* in the second direction Y.

The curved portion 131 may be disposed to correspond to the discharge panel 40 in the third direction X. The curved portion 131 may be disposed behind the discharge panel 40.

When a portion of the discharge panel 40 is pressed by an external force, the curved portion 131 supports the discharge panel 40 to prevent the portion of the discharge panel 40 from being moved in the third direction X.

In detail, when an external force is applied to a portion of the discharge panel 40 from the front side to the rear side of the air conditioner 1, the portion of the discharge panel 40 may be bent backward, causing the shape of the discharge panel 40 to be changed in shape.

In this case, as the curved portion 131 supports the discharge panel 40 in the front-rear direction, the portion of the discharge panel 40 is prevented from being bent backward of the air conditioner 1.

A front portion of the curved portion 131 may be formed along the curve line 131*a* which is convexly formed in the direction toward the discharge panel 40 as described above.

Accordingly, when an external force is applied in the third direction X, the discharge panel 40 may press the curved portion 131 along the direction of the external force in the third direction X. The external force is dispersed by the curve line 131*a* formed on the front portion of the curved portion 131, so that high rigidity may be maintained in the third direction X.

That is, when the discharge panel 40 comes into contact with the curved portion 131 by an external force, the discharge panel 40 comes into contact with an area of the curved portion 131 in which the curve line 131*a* is formed, and thus the external force transmitted to the curved portion 131 may be subject to direction dispersion.

Accordingly, the curved portion 131 may safely support the discharge panel 40 even with a high external force.

The third frame 130 may be spaced apart from the discharge panel 40 in the third direction X. In detail, the curved portion 131 and the discharge panel 40 may be spaced apart from each other at a predetermined distance d in the third direction X.

In the related art, a support rib corresponding to the third frame 130 is disposed in contact with the rear surface of the discharge panel, and thus dew condensation occurs in an area where the discharge panel and the support rib are in contact with each other.

The temperature at a portion of the support rib in contact with the discharge panel is increased by the outside air, and the temperature difference introduced by the increasing temperature may cause dew condensation.

In order to prevent the dew condensation, the curved portion 131 may be spaced apart from the discharge panel 40 to prevent the temperature of the curved portion 131 from rising due to the outside air.

The predetermined distance d between the curved portion 131 and the discharge panel 40 in the third direction X is set to a value in which the discharge panel 40 temporarily bent by the predetermined distance d due to an external force is restored to the original shape by the elasticity of the metal material when the external force disappears. The predetermined distance d between the curved portion 131 and the discharge panel 40 in the third direction X may be set to a range of values from approximately 1 mm to 10 mm. Preferably, the predetermined distance d between the curved portion 131 and the discharge panel 40 in the third direction X may be provided between 2 mm and 5 mm.

As described above, since the discharge panel 40 is formed of a metal material, the discharge panel 40 may have a predetermined restoring force against an external force by the elasticity of the metal material. Accordingly, even when the third frame 130 is not in contact with the discharge panel 40, the discharge panel 40 may be stably supported by the third frame 130 against an external force.

That is, the configuration substantially allowing the discharge panel 40 to be coupled to and supported against the housing 10 is the configuration of the first frame 110 and the second frame 120 or the connection frame 102. The third frame 130 is a configuration to support the discharge panel 40 that may be temporarily pressed in the third direction X when an external force is exerted on the discharge panel 40 in the third direction X.

When a plurality of third frames 130 are arranged in the first direction Z, the number of the third frames 130 may be determined in consideration of the strength of the material of the discharge panel 40.

In addition, due to the predetermined distance d between the curved portion 131 and the discharge panel 40 in the third direction X, the curved portion 131 and the discharge panel 40 are prevented from colliding with each other during operation of the air conditioner 1, so that noise may be reduced.

In addition, in the related art, dust is caught between the discharge panel 40 and the support ribs, but according to the disclosure, the curved portion 131 and the discharge panel 40 are disposed to be spaced apart from each other, so that dust is not caught between the curved portion 131 and the discharge panel 40, so that hygiene quality may be improved when compared to the related art.

At least a part of the third frame 130 in the second direction Y may have a cross section including a curve line. Preferably, the third frame 130 may have a circular cross section.

As described above, the third frame 130 is disposed on the first flow path S1, and the above configuration prevents the flow of air in the first flow path S1 from being restrained. In particular, a rear portion 131*b* of the curved portion 131 may have a curved surface shape that converts a flow of air colliding with the curved portion 131 into a streamlined flow.

This may be equally applied to a connecting portion 132 to be described below.

The third frame 130 may include a coupling portion 133 that couples the third frame 130 to the rear side of the first frame 110 or the second frame 120 and the connecting portion 132 connecting the coupling portion 133 to the curved portion 131.

The coupling portion 133 and the connecting portion 132 may each be provided in pairs so as to be disposed at opposite ends of the curved portion 131. Since each pair of coupling portions 133 and connecting portion 132 is provided as a symmetrical arrangement, the coupling portion 133 and the connecting portion 132 extending toward the first frame 110 among each pair of coupling portions 133 and connecting portion 132 will be described.

The connecting portions 132 are portions extending from the opposite ends of the curved portion 131 in the second direction Y.

The connecting portion 132 may extend from an end of the curved portion 131 to the rear surface of the first frame 110.

The connecting portion 132 may include a first region obliquely extending with respect to the third direction X and a second region extending from the first region in the second direction Y.

However, the disclosure is not limited thereto, and the second region may extend in the second direction Y and further obliquely extend with respect to the first direction Z or the third direction X.

The first region and the second region allow the coupling portion 133 to be disposed on the rear surface of the first frame 110.

However, the disclosure is not limited thereto, and the first region of the connecting portion 132 may extend in the third direction X to be perpendicular to the first region and the second region. In addition, the first region and the second region are not distinguished from each other, and the connecting portion 132 may obliquely extend with respect to the third direction X and the second direction Y.

Referring to FIGS. 8 and 9, the coupling portion 133 may include a bent region at which the coupling portion 133 changes from extending in the second direction Y to extending in the first direction Z.

The coupling portion 133 may extend along a substantially semi-circular curved line. The direction in which the coupling portion 133 extends from the connecting portion 132 may be approximately opposite to the direction in which the end of the coupling portion 133 is headed.

That is, the coupling portion 133 extends to the left side from one end of the connecting portion 132, and at the bent region, changes to extend to the right side.

Since the coupling portion 133 may change in the extending direction at the bent region, the coupling portion 133 may include an inner region 134 that is a space surrounded by the bent region of the coupling portion 133.

The inner region 134 may be formed as a space that is open in the third direction X. The inner region 134 may be provided in a shape having at least a part thereof open in the first direction Z or the second direction Y. However, the disclosure is not limited thereto, and the inner region 134 may be provided in an annular shape so as to be completely closed in the first direction Z or the second direction Y.

The restraining member 150 may be coupled to the first frame 110 by passing through the inner region 134 to restrain the third frame 130 onto the rear side of the first frame 110.

The restraining member 150 may be provided in a screw shape to be screwed to the rear side of the first frame 110. However, the disclosure is not limited thereto, and the restraining member 150 may be fitted or inserted into the rear side of the first frame 110 by passing through the inner region 134.

The first frame 110 and the second frame 120 may each include a metal member 140 inserted thereinto. The respective metal members 140 are inserted into the first frame 110 and the second frame 120 in a symmetrical arrangement, and fastening components of the restraining members 150 fastened to the respective metal members 140 also have a symmetrical arrangement. The following description will be made based on the first frame 110 and redundant description will be omitted.

As described above, the first frame 110 may be formed of a material such as a plastic injection molding. In this case, the first frame 110 may be broken when the restraining member 150 is fastened to the first frame 110.

Therefore, the restraining member 150 may be directly fastened to the metal member 140 inserted into the first frame 110 to improve the coupling strength while securing the rigidity.

The first frame 110 may include a rear cover 110*a* forming a rear surface of the first frame 110.

The rear cover 110*a* may be provided to cover the rear surface of the first frame 110 after the metal member 140 is disposed behind the first frame 110.

Alternatively, the rear cover 110*a* may be coupled to the rear of the first frame 110 to cover the rear surface of the first frame 110, and then the metal member 140 may be inserted into the first frame 110. The order in which the first frame 110, the rear cover 110*a*, and the metal member 140 are assembled may vary depending on the convenience of assembly.

The second frame 120 may include a rear cover 120*a* forming a rear surface of the second frame 120. The rear cover 120*a* may be provided to cover the rear surface of the second frame 120 after the metal member 140 is disposed behind the second frame 120. Alternatively, the rear cover 120*a* may be coupled to the rear of the second frame 120 to cover the rear surface of the second frame 120, and then the metal member 140 may be inserted into the second frame 120.

However, the disclosure is not limited thereto, and the first frame 110 and the rear cover 110*a* may be integrally formed with each other, and the metal member 140 may be inserted into an inner space of the first frame 110.

The first frame 110 may include an exposing portion 113 on the rear surface of the first frame 110 that exposes the metal member 140 to the outside. The restraining member 150 may be directly coupled to the metal member 140 through the exposing portion 113.

The first frame 110 may include a guide portion 112 that guides a position to which the third frame 130 is restrained when the third frame 130 is coupled to the first frame 110.

The guide portion 112 may guide the position of the third frame 130 such that the coupling portion 133 of the third frame 130 is disposed at a position substantially corresponding to the exposing portion 113 in the third direction X.

The guide portion 12 may be provided to guide the position of the connecting portion 132 connected in the second direction Y such that the coupling portion 133 is disposed at a position corresponding to the exposing portion 113.

However, the disclosure is not limited thereto, and the guide portion 112 may be disposed adjacent to the exposing portion 113 to directly guide the position of the coupling portion 133.

Hereinafter, an air conditioner 1 according to another embodiment of the disclosure will be described. Components except for a fourth frame 160 described below are the same as those of the air conditioner 1 according to the above embodiment of the disclosure, and thus details of thereof will be omitted.

Figure 10:
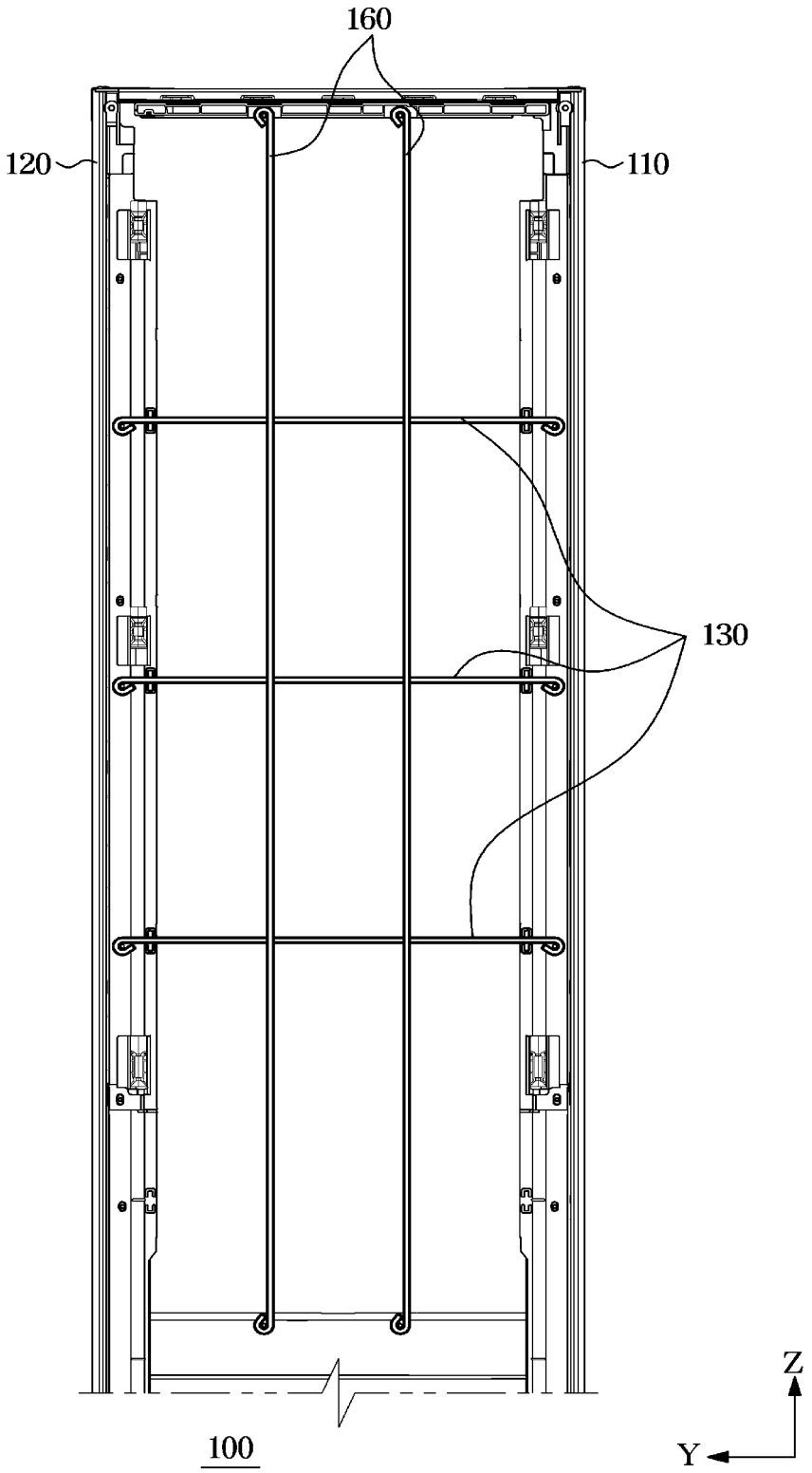
FIG. 10 is a view illustrating a support member of an air conditioner according to another embodiment of the disclosure.

FIG. 10 is a view illustrating a support member of an air conditioner according to another embodiment of the disclosure.

The support member 100 may include a fourth frame 160 extending in the first direction Z.

The fourth frame 160 may be disposed on the first flow path S in the third direction X.

The fourth frame 160 may be formed of a metal material. In detail, the fourth frame 160 may be formed of the same material as the third frame 130.

The fourth frame 160 may further improve the restoring force of the discharge panel 40 when an external force is generated, and may additionally support the discharge panel 40 even with a large external force.

The fourth frame 160 may be provided in plural, but the disclosure is not limited thereto. A single fourth frame 160 may be disposed at the center of the opening 103 in the second direction Y.

Hereinafter, an air conditioner 1 according to another embodiment of the disclosure will be described. Components except for an intermediate member 170 described below are the same as those of the air conditioner 1 according to the above embodiment of the disclosure, and thus details of thereof will be omitted.

Figure 11:
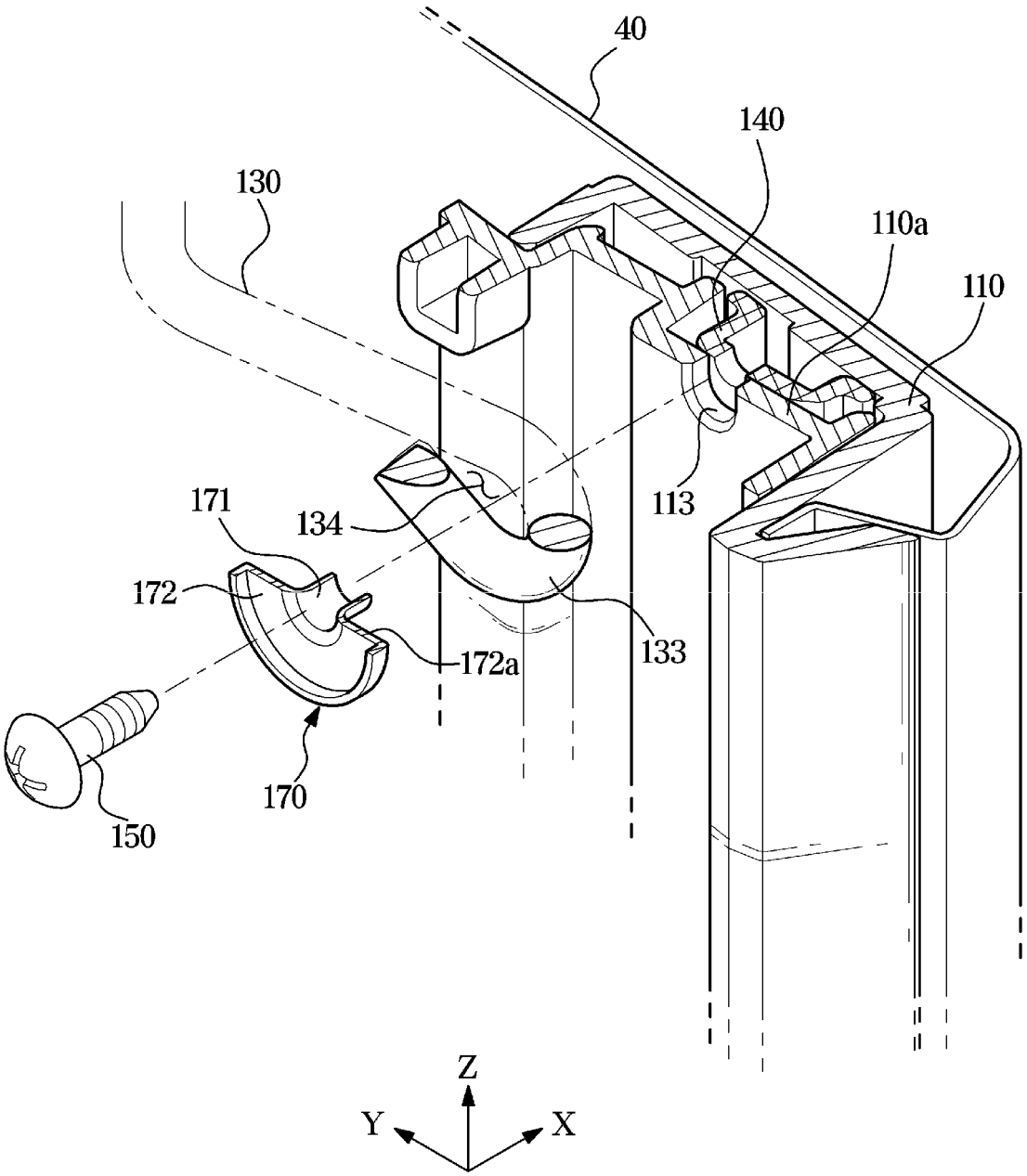
FIG. 11 is a perspective view of a cross section of a part of an air conditioner according to another embodiment of the disclosure.

FIG. 11 is a perspective view of a cross section of a part of an air conditioner according to another embodiment of the disclosure.

The support member 100 may include an intermediate member 170 disposed between the coupling portion 133 of the third frame 130 and the restraining member 150.

During operation of the air conditioner 1, vibration may be transmitted to the support member 100 by vibration of the blowers 21 and 26 or air flowing in the air conditioner 1.

In particular, since the third frame 130 is disposed on the first flow path S, the third frame 130 may collide with the air flowing on the first flow path S and thus cause vibration.

Accordingly, noise caused by friction between the third frame 130 and the restraining member 150 may occur, and the restraining member 150 may be broken or may be separated.

To prevent such a limitation, the support member 100 may include the intermediate member 170.

The intermediate member 170 may be formed of a material such as rubber and may be provided to absorb the vibration generated from the third frame 130.

The intermediate member 170 may include a passing portion 171 passing through the inner region 134 and a contact portion 172 coming in contact with the coupling portion 133. The contact portion 172 may include a contact surface 172a coming into direct contact with the coupling portion 133.

The contact portion 172 prevents the restraining member 150 from coming into direct contact with the third frame 130. Therefore, vibration generated from the third frame 130 may be prevented from being transmitted to the restraining member 150.

As is apparent from the above, the air conditioner includes a main outlet in which a discharge panel having a plurality of discharge holes is disposed and a guide outlet that performs a general blowing, so that various air discharge methods can be implemented.

The air conditioner includes a support member for supporting a discharge panel, and the support member includes a metal frame formed of a metal material, so that the discharge panel can be effectively restored in response to shape deformation at a time of being pressed by an external force.

The metal frame of the support member is spaced apart from the discharge panel, thereby reducing dew formation that may occur between the discharge panel and the metal frame.

Although few embodiments of the disclosure have been shown and described, the above embodiment is illustrative purpose only, and it would be appreciated by those skilled in the art that changes and modifications may be made in these embodiments without departing from the principles and scope of the disclosure, the scope of which is defined in the claims and their equivalents.

What is claimed is:

1. An air conditioner comprising:

a housing;

a discharge panel arranged in front of the housing and having a plurality of discharge holes to discharge air; and a support member arranged behind the discharge panel to support the discharge panel, wherein the support member includes:

a first frame to support one side of the discharge panel and formed to extend in a first direction, a second frame to support another side of the discharge panel and arranged parallel with the first frame and formed to extend in the first direction, and a third frame arranged between the first frame and the second frame, the third frame being formed to extend in a second direction perpendicular to the first direction with a curved portion curved toward the discharge panel, wherein the third frame includes:

a first connecting portion which extends from one end among ends of the curved portion toward to the first frame, the first connecting portion including a first region to extend in the second direction and a second region formed to extend toward the curved portion, and a second connecting portion which extends from another end among the ends of the curved portion that is opposite the one end of the curved portion toward the second frame, the second connecting portion including a first region to extend in the second direction and a second region formed to extend toward the curved portion, wherein the first connecting portion and the second connecting portion extend from the ends of the curved portion in a direction away from the discharge panel, respectively, and the third frame is formed of a metal material, wherein the curved portion is arranged to be spaced apart from the discharge panel in a third direction.

2. The air conditioner of claim 1, wherein the third frame has a curved line convexly formed in the third direction.

3. The air conditioner of claim 1, wherein the third frame has at least a portion thereof in the second direction and has a cross section which includes a curved line.

4. The air conditioner of claim 1, wherein the third frame is formed of a material different from a material forming the first frame and the second frame, and the material forming the third frame has a rigidity higher than a rigidity of the material forming the first frame and the second frame.

5. The air conditioner of claim 1, wherein the third frame includes a coupling portion arranged at one end thereof which is coupleable to the first frame or the second frame.

6. The air conditioner of claim 5, wherein the support member further includes a restraining member configured to restrain the coupling portion onto the first frame or the second frame such that the coupling portion is coupled to the first frame or the second frame.

7. The air conditioner of claim 6, wherein the first frame further includes a metal member that is inserted into the first frame, and the restraining member is coupled to the metal member.

8. The air conditioner of claim 7, wherein the support member further includes an intermediate member arranged between a pair of the coupling portion and the restraining member.

9. The air conditioner of claim 6, wherein the coupling portion includes a bent region at which the coupling portion formed to extend in the second direction is formed to extend in the first direction, the restraining member is inserted into an inner region of the coupling portion that is formed by the bent region so that the coupling portion is restrained onto the first frame or the second frame.

10. The air conditioner of claim 5, wherein the curved portion has a curved line convexly formed in a third direction and the first connecting portion and the second connecting portion are formed to connect the ends of the curved portion to the coupling portion, respectively, wherein the second region of the first connecting portion and the second connecting portion is respectively connected to the curved portion and formed to extend in a direction opposite to a protruding direction of the curved portion, and the first region of the first connecting portion and the second connecting portion is formed to extend from the second region in the second direction and is respectively connected to the coupling portion.

11. The air conditioner of claim 1, wherein the support member further includes:

a connection frame connecting the first frame to the second frame and formed to extend in the second direction; and an opening formed by the first frame, the second frame, and the connection frame in a third direction perpendicular to the first direction and the second direction, wherein the opening is provided between the housing and the discharge panel, and the third frame is arranged above the opening in the third direction.

12. The air conditioner of claim 1, wherein the support member further includes a fourth frame arranged between the first frame and the second frame and extending in a direction parallel to the first frame and the second frame.

13. The air conditioner of claim 1, further comprising an inlet provided in the housing, a heat exchanger arranged along a flow path formed between the inlet and the discharge panel, and a blower allowing air suctioned through the inlet to be discharged through the discharge panel.

14. The air conditioner of claim 13, further comprising:

an auxiliary inlet provided in the housing, a guide outlet configured to discharge air introduced through the auxiliary inlet, the air introduced through the auxiliary inlet being mixed with air discharged from the discharge panel, and an auxiliary blower arranged on a guide flow path formed between the auxiliary inlet and the guide outlet and allowing the air introduced through the auxiliary inlet to be discharged through the guide outlet.

15. An air conditioner comprising:

a housing;

a discharge panel arranged in front of the housing and having a plurality of discharge holes that discharge air; and a support member arranged behind the discharge panel to support the discharge panel, wherein the support member includes:

a first frame to support one side of the discharge panel and formed to extend in a first direction, a second frame to support another side of the discharge panel and arranged in parallel with the first frame and formed to extend in the first direction, and a third frame arranged between the first frame and the second frame, the third frame being formed to extend in a second direction perpendicular to the first direction with a curved portion curved toward the discharge panel, wherein the third frame includes:

a first connecting portion which extends from one end among ends of the curved portion toward the first frame, the first connecting portion including a first region to extend in the second direction and a second region formed to extend toward the curved portion, and a second connecting portion which extends from another end among the ends of the curved portion that is opposite the one end of the curved portion toward the second frame, the second connecting portion including a first region to extend in the second direction and a second region formed to extend toward the curved portion, wherein the first connecting portion and the second connecting portion extend from the ends of the curved portion in a direction away from the discharge panel, respectively, and wherein the curved portion is spaced apart from the discharge panel in a third direction perpendicular to the first direction and the second direction.

16. The air conditioner of claim 15, wherein the third frame is formed of a metal material.

17. The air conditioner of claim 15, wherein the third frame has a curved line convexly formed in the third direction.

18. The air conditioner of claim 15, wherein the third frame is formed of a material different from a material forming the first frame and the second frame, and the material forming the third frame has a rigidity higher than a rigidity of the material forming the first frame and the second frame.

19. An air conditioner comprising:

a housing having a first inlet and a second inlet;

a main outlet formed in the housing to discharge air introduced through the first inlet;

a guide outlet configured to discharge air introduced through the second inlet, the air introduced through the second inlet being mixed with the air discharged through the main outlet;

a heat exchanger arranged on a first flow path formed between the first inlet and the main outlet;

a first blower arranged to suction air through the first inlet and discharge the suctioned air through the main outlet;

a second blower arranged to suction air through the second inlet and discharge the suctioned air through the guide outlet;

a discharge panel arranged in front of the main outlet and having a plurality of discharge holes that discharge air; and a support member arranged between the main outlet and the discharge panel and on which the discharge panel is to be supported, wherein the support member has a curved line convexly formed in a direction toward the discharge panel, the support member to extend in a second direction perpendicular to the first direction, the support member including:

a first connecting portion which extends from one end among ends of the curved line toward a first frame formed to extend in a first direction, the first connecting portion including a first region to extend in the second direction perpendicular to the first direction and a second region formed to extend toward the curved line, and a second connecting portion which extends from another end among the ends of the curved line that is opposite the one end of the curved line toward a second frame, the second connecting portion including a first region to extend in the second direction and a second region formed to extend toward the curved line, wherein the first connecting portion and the second connecting portion extend from the ends of the curved line in a direction away from the discharge panel, respectively, wherein a portion of the support member with the curved line is arranged to be spaced apart from the discharge panel.

* * * * *